United States Patent [19]

McLaughlin

[11] 4,328,978

[45] May 11, 1982

[54] IDENTIFICATION DEVICE FOR HOSPITAL PATIENTS

[76] Inventor: John T. McLaughlin, 1839 Risa Pl., Glendale, Calif. 91208

[21] Appl. No.: 192,616

[22] Filed: Sep. 30, 1980

[51] Int. Cl.[3] ..... B42D 15/00; G09F 3/14

[52] U.S. Cl. ..... 283/7; 40/21 C

[58] Field of Search ..... 283/7, 8, 21; 40/21 C, 40/304, 406, 2.2, 542, 579, 580; 128/690; 24/16 PB

[56] References Cited

U.S. PATENT DOCUMENTS 4,199,882 4/1980 Clayman ..... 40/21 C 4,226,036 10/1980 Krug ..... 283/7

*Primary Examiner*—Paul A. Bell

*Assistant Examiner*—John S. Brown

*Attorney, Agent, or Firm*—Ralph B. Pastoriza

[57] ABSTRACT

The identification device takes the form of a plastic holder worn about a patient's wrist in the manner of a wristwatch. The holder itself has a fluorescent coating on the top surface emitting light. A patient identification card is positioned on this fluorescent surface, the identification card being perforated with a patient identifying number. The emitted light from the fluorescent material thus shines up through the perforations in this number. Any particular procedure to be carried out on the patient is directed in an appropriate order blank signed by a physician or other hospital personnel. Such order blank for the patient includes the patient's identification number which number is also perforated on the order blank. By then positioning the order blank portion upon which the number is perforated over the patient's identifying number in the holder, if the numbers are the same, the light will then pass through both the perforations. If the numbers are different, neither number can be properly identified and it is immediately known that the order is not for that particular patient. The risk of specific orders or procedures being carried out on the wrong patient is thus substantially eliminated.

6 Claims, 3 Drawing Figures

IDENTIFICATION DEVICE FOR HOSPITAL PATIENTS

This invention relates generally to identification techniques and more particularly to an improved identification device for hospital patients.

BACKGROUND OF THE INVENTION

Normally when a patient is admitted to a hospital, he is tagged with a wristband which includes his name and may further include an identifying number. This band will remain on the patient's wrist until he is discharged from the hospital and serves as a positive identifying means during the patient's stay so that hospital personnel subsequently coming in contact with the patient can properly identify the patient.

Where one or more patients have the same names, it is possible that orders to be carried out on one patient may mistakenly be carried out on another with the same name, even though code numbers in addition to names are often used. Even if there is no ambiguity in the names or numbers, the names or numbers themselves can become obliterated or partially obliterated thus again resulting in possible mistakes.

The problem of partially or completing obliterated numbers can be solved by actually perforating the numbers in an appropriate identification card or in the band itself but symbols or numbers defined by a series of perforations are often difficult to read.

BRIEF DESCRIPTION OF THE PRESENT INVENTION

With the foregoing in mind, the present invention contemplates an improved identification device wherein the risk of associating a particular order with the wrong patient is virtually eliminated.

More particularly, in accord with this invention, the identification device comprises a holder having a receiving surface for a patient's identification card. This card includes a patient identifying number which is perforated in the card. The holder itself is secured about a patient's wrist with an appropriate band so that it is carried in the same manner as a wristwatch. The holder includes light emitting means for passing light through the perforations defining the identification number in the identification card so that this number is clearly visible. Appropriate registration means are provided on the margins of the holder for receiving and effecting registration on at least a portion of an order blank which has been perforated with a patient number.

With the foregoing arrangement, if the perforated number on the order blank is the same as the patient number, then the light will be clearly visible passing through both of the registering perforations of the respective numbers and it is thus immediately known that the order is for the specific patient whose identification number matches. On the other hand, if the perforated number on the order blank differs in any respect from the patient's identification number, when the portion of the order blank is registered over the patient's number, some of the light will be blocked as a consequence of the difference in the numbers, thereby indicating that either the patient is not the correct patient or the order is not the correct order.

By utilizing the foregoing technique, the matching or mismatching is immediately evident and thus far greater reliability is assured in proper patient identification.

BRIEF DESCRIPTION OF THE DRAWINGS

A better understanding of this invention will be had by now referring to a preferred embodiment thereof as illustrated in the accompanying drawings in which.

DETAILED DESCRIPTION OF THE PREFERRED EMBODIMENT

Figure 1:
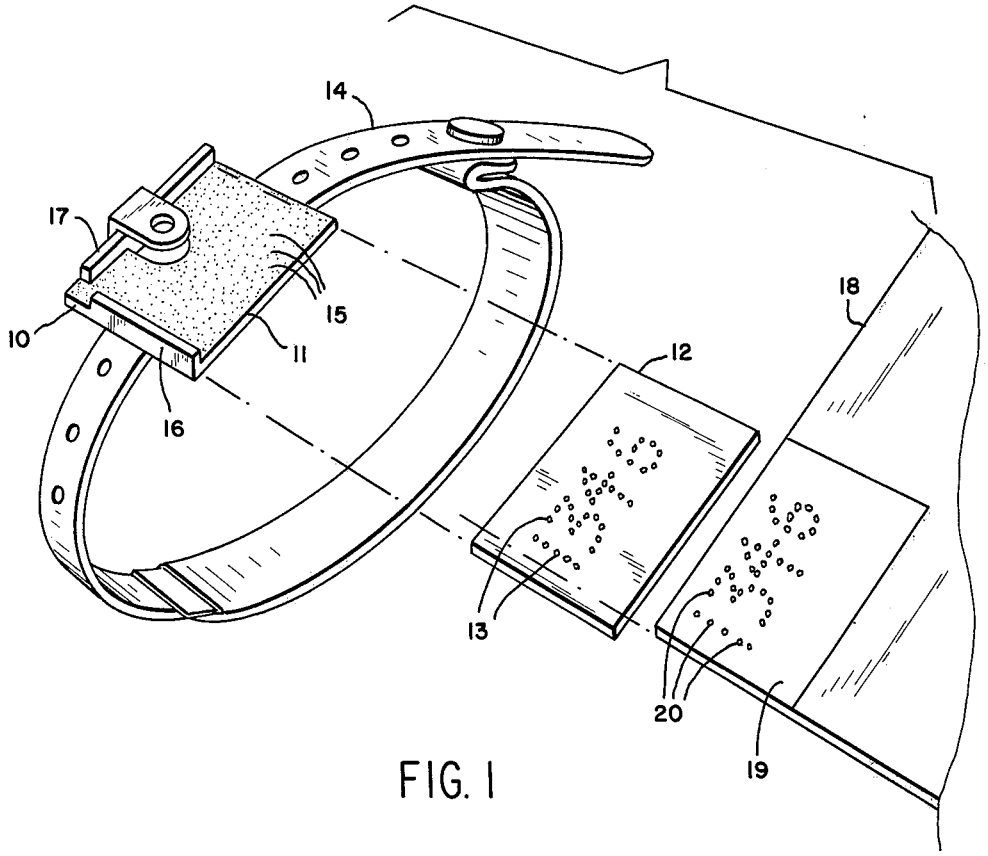
FIG. 1 is an exploded perspective view of the identification device of this invention.

Referring first to FIG. 1, the identification device includes a holder 10 having a receiving surface 11 for receiving a patient's identification card indicated exploded away from the surface at 12. The patient's identification card 12 has a patient identifying number perforated therethrough as indicated at 13. This number, by way of example, is a four digit number 1346.

The holder 10 itself is carried on a wristband 14 so as to be worn in the manner of a watch.

A light emitting means preferably in the form of a fluorescent coating 15 is provided on the top surface 11 the purpose of which will become clearer as the description proceeds.

In addition to the light emitting means, the holder is also provided with registration means in the form of two stops 16 and 17 at adjacent marginal edges of the receiving surface 11. These stops are provided to enable registration of an order blank shown to the right of FIG. 1 at 18. Order blank 18 includes a portion 19 having a patient identifying number 20 perforated therethrough. The dimensions of the portion 19 and position of the number 20 are such that after the identification card 12 has been positioned in the holder 10, positioning of the marginal edges of the order blank 18 against the stops 16 and 17 respectively results in proper registration of the number 20 with the number 13.

Figure 2:
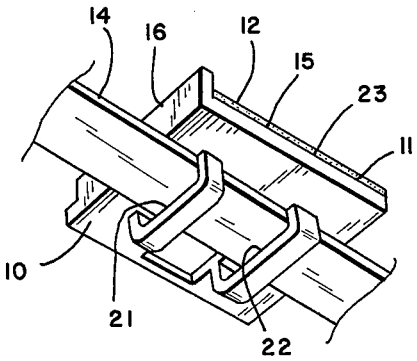
FIG. 2 is a fragmentary perspective view looking upwardly at the other side of the device of FIG. 1 in assembled relationship; and, FIG. 3 illustrates the device of FIG. 1 in assembled relationship together with a portion of an order blank properly positioned on the device for making an identification.

FIG. 2 illustrates the underside of the holder 10 wherein it will be noted that channels 21 and 22 are formed for receiving the band 14. Any other suitable and reliable securing means may be provided for supporting the holder to the band.

Also indicated in FIG. 2 at 23 is an adhesive means beneath the identification card 12 for securing the card to the top surface 11. It will be understood that the card 12 will overlie the fluorescent light emitting material 15 on the top surface 11 and will simply adhere thereto, the light passing up through the perforations defining the patient's identifying number 13 when the card 12 is in position.

It can readily be appreciated that the patient's identification number will be very easy to read even at nighttime because of the light passed up through the perforations defining the number.

As briefly described in FIG. 1, for every order blank directing that a specific procedure or operation be carried out on a patient, there is provided the patient identifying number as indicated at 20 in the specific position of the card portion 19. Thus, the order can be matched up with the patient very easily by simply positioning the order blank 18 with a portion 19 overlying the identification card 12 in holder 10, all as illustrated in FIG. 3.

Figure 3:
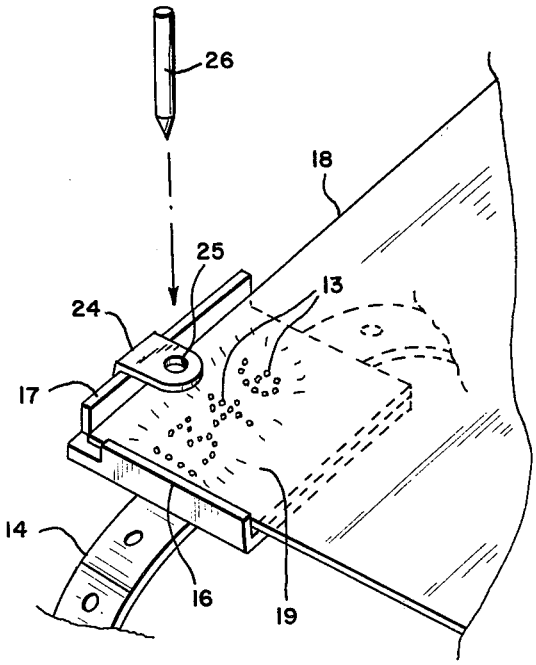

As shown in FIG. 3, the number on the order blank 18 precisely registers with the patient's number 13 so that light will shine through both numbers and they will readily be identifiable, indicating that the order properly matches the patient. However, it will also be evident that should the number 20 on the order blank be different from the number 13 on the patient's identification card, then a mismatching will occur which mismatching will be immediately evident because some of the light from the light emitting material will be blocked by the mismatched perforations. In fact, it will be virtually impossible to figure out any specific number if the two do not register exactly or are not identical numbers. Thus, one is immediately advised of a mismatch between the order and the patient.

In the preferred embodiment, as illustrated in FIG. 3 there is provided a marker guide 24 having an opening 25 for receiving a pointer or pointed object 26. With this arrangement, when one of the hospital personnel is matching the order blank 18 with the patient's identification card in the holder 10, he or she will use a needle or pointed object such as a pencil passed through the opening 25 to mark the order blank 18 either with an identification mark if a pencil is used or by a perforated opening if a needle or pointer is used. This mark is made on the order blank 18 when it is in properly registered position.

With the foregoing arrangement, after the order blank 18 has been removed from the holder 10, or is otherwise separated therefrom, a simple inspection of this order blank will indicate immediately whether or not a proper matching has been carried out. Thus, the marker guide and marker 26 as illustrated in FIG. 3 serve as a convenient means for enabling hospital personnel to check immediately whether the order has at least been positioned properly in the holder for identification purposes.

From all of the foregoing, it will be appreciated that any procedure to be carried out on a patient by a doctor, registered nurse, technician or licensed vocational nurse can be directed in an order blank such as the order blank 18 with the proper patient's identification number thereon. Before the specific procedure is to be carried out, the hospital personnel will simply effect a registration of the order with the identification number worn by the patient on his wrist and determine if the numbers correspond by simply glancing at the same.

As stated, if the order is proper and the patient is proper, the numbers will be the same and the light emitted will shine through both sets of perforations and thus the number can easily be read. If there is any mismatching in one or more digits, it will not be possible to read a complete four digit number because of light blockage and the hospital personnel will then know that a mismatch has occurred.

The specific procedures involved may include, among many others, blood tests, X-rays, pulmonary tests, electrocardiograms, surgical procedures and the like.

While this invention has been described as used by hospital patients, it is evident that the identification technique can be used in any environment different from hospitals wherein similar problems are involved in that a positive identification must be effected.

I claim:

1. An identification device for hospital patients including, in combination:

(a) a holder having a receiving surface on its top side for receiving a patient's identification card which card has been perforated with a patient identifying number;

(b) means for securing said holder to the patient whose identification number is carried by the holder;

(c) light emitting means on said holder for passing light through the perforations defining said identification number; and (d) registration means on said holder for receiving and effecting registration of at least a portion of an order blank which has been perforated with a patient's identifying number whereby when said latter mentioned identifying number is the same as the identifying number on the patient's identifying card carried by the holder, said light will pass through both numbers so that proper identity of the order with the patient is assured, whereas if the numbers are different, such will be immediately indicated by a blocking of at least a portion of the light so that it is known that the order is not for the particular patient in question.

2. A device according to claim 1, in which said means for securing said holder to said patient comprises a band adapted to be secured about the patient's wrist; and channel means formed in the bottom portion of the holder receiving said band so that said holder can be worn in the manner of a wristwatch.

3. A device according to claim 1, in which said light emitting means comprises a fluorescent coating on said top receiving surface over which said identification card is positioned.

4. A device according to claim 1, in which said registration means includes at least two stops at adjacent marginal edges of said top receiving surface for indexing said portion of said order on the surface to be in registration with said identification card.

5. A device according to claim 1, including a marker guide on said holder positioned such that when a pointed object is passed through the guide it will make an identification mark at a given position on said portion of said order blank only if said order blank has been properly registered on said surface by said registration means so that there is provided a means for hospital personnel to indicate on said order blank that it has been properly positioned on said holder for making the card identification.

6. A device according to claim 1, including adhesive means on said holder for holding said identification card in proper position overlying said light emitting means on said surface.

* * * * *